US006337690B1

(12) United States Patent
Ashburn et al.

(10) Patent No.: US 6,337,690 B1
(45) Date of Patent: Jan. 8, 2002

(54) TECHNIQUE FOR REDUCING THE FREQUENCY OF FRAME BUFFER CLEARING

(75) Inventors: Jon L Ashburn, Fort Collins; Bryan G Prouty, Wellington, both of CO (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/283,336

(22) Filed: Mar. 31, 1999

(51) Int. Cl.[7] ..... G09G 5/39
(52) U.S. Cl. ..... 345/531; 345/545; 345/561
(58) Field of Search ..... 345/501, 503, 345/531, 545, 559, 561

(56) References Cited

U.S. PATENT DOCUMENTS 5,388,205 A * 2/1995 Cantor et al. ..... 395/501
5,748,864 A * 5/1998 Martin ..... 345/422
5,805,868 A * 9/1998 Murphy ..... 345/502
5,841,447 A * 11/1998 Drews ..... 345/523

* cited by examiner

*Primary Examiner*—Ulka J. Chauhan
(74) *Attorney, Agent, or Firm*—Kevin M. Hart

(57) ABSTRACT

A clear color and count are stored in a frame buffer controller and in a video controller. The image buffer is cleared by writing the clear color into a color bit field and the count into a count bit field of each pixel. For each frame drawn, the count bit field of each pixel modified is updated with the count stored in the frame buffer controller. The counts stored in the frame buffer controller and the video controller are incremented with each new frame. When the counts reach maximum, the process repeats. Each time a pixel is read, the pixel's color bit field is replaced with the stored clear color if the pixel's count bit field is not equal to the stored count. The color bit field and the count bit field may be part of the same word of frame buffer memory. Or, the count value may be stored in an alpha bit field in lieu of an alpha value. If so, each time a pixel is read by the frame buffer controller, the pixel's count bit field may be replaced with a default alpha value stored in the frame buffer controller. Numerous pairs of clear count and clear color registers may be provided in the video controller, each pair corresponding to one window on the display. And numerous pairs of clear count and clear color registers may be provided in the frame buffer controller to better support double buffering and stereo operations.

15 Claims, 3 Drawing Sheets

TECHNIQUE FOR REDUCING THE FREQUENCY OF FRAME BUFFER CLEARING

FIELD OF THE INVENTION

This invention relates generally to computer graphics, and more specifically to techniques for reducing time spent clearing areas of the frame buffer.

BACKGROUND

In computer graphics, the operation of clearing a large area of frame buffer memory is very expensive in terms of both time and processing resources. For example, in a system having 1280×1024 resolution, clearing the frame buffer requires accessing more than one million pixels. Indeed, clearing such a large area of memory can require more time than it takes to draw a frame of an image after the clear has been completed. Designers have attempted to address this problem either by speeding up the process of clearing or by avoiding the process altogether.

For example, frame buffers have been implemented using physical memory devices that have a special hardware clear feature. In such embodiments, the operation of clearing frame buffer memory is accelerated. On the other hand, such special-purpose physical memory devices add to the cost of the implementation.

Another technique is taught in U.S. Pat. No. 5,851,447, issued to Michael D. Drews and assigned to Evans & Sutherland Computer Corporation (hereinafter "Drews"). Drews teaches allocating an additional field in frame buffer memory for each pixel and storing a version number in the additional field. An alternate pixel value (a clear value) and a current version number are maintained in a pixel processor. During frame buffer reads executed by the pixel processor, the version number corresponding to a pixel is read from the frame buffer first. If the version number read from the frame buffer is not equal to the current version number stored in the pixel processor, then the alternate pixel value stored in the pixel processor is substituted for the pixel value that would have been read from the frame buffer. On the other hand, if the version numbers are equal, then the pixel value is read from the frame buffer and used. According to this technique, multiple pixels in the frame buffer can be made to appear to have been modified simply by changing the current version number stored in the pixel processor. Thus, the frequency with which "real" clearing operations must be performed can be reduced.

One problem with the Drews technique is that it requires more storage space in the frame buffer for every pixel. This requirement represents a significant drawback in high-resolution systems wherein adding even a single byte of storage space to the frame buffer for each pixel can mean adding more than one million bytes of memory. Moreover, these newly-added bytes must be written every time a "real" clearing operation is performed, thus compounding the original problem.

Another problem with the Drews technique is that in many cases it prescribes more than one read for accessing pixel data from the frame buffer. This requirement represents a drawback as well, because read bandwidth must be preserved if frame buffer accesses are to be efficient.

Another problem with the Drews technique is that modem window-based computing environments allow multiple windows to be displayed on the screen at the same time. The Drews patent makes no mention of window-based computing environments, and it fails to teach or suggest how the Drews technique could be applied in such an environment. Indeed, the Drews patent appears to be concerned solely with activity within the pixel processor, to the exclusion of activity within the display controller.

It is therefore an object of the invention to provide a fast clear technique that is more efficient than Drews in terms of frame buffer memory and read bandwidth utilization.

It is a further object of the invention to provide a fast clear technique that is useful in a modern window-based environment in which more than one window may be displayed on the screen at the same time.

SUMMARY OF THE INVENTION

The invention includes numerous aspects, each of which contributes to the achievement of the above objects.

In one aspect, the invention includes a method and apparatus for organizing and utilizing an image buffer to reduce the frequency of buffer clear operations. A clear color value is stored in a first clear color register in a frame buffer controller and w also in a second clear color register in a video controller. A count value is stored in a first clear count register in the frame buffer controller and in a second clear count register in the video controller. The image buffer is cleared by writing the clear color value into a color bit field and writing the count value into a count bit field of each pixel. Thereafter, each time a frame is drawn into the image buffer, the count bit field of each pixel modified is updated with the count value stored in the first clear count register. After each frame, the count value in the first and second clear count registers is incremented. When the count value reaches a maximum, the process begins again with a clearing of the image buffer as described above.

In one embodiment, the color bit field and the count bit field are part of the same word of frame buffer memory. In another embodiment, the count value is stored in an alpha bit field of each pixel in the image buffer, in lieu of an alpha transparency value. A default alpha value is stored in a default alpha register in the frame buffer controller and, each time a pixel is read from the image buffer, the count value read from the pixel's count bit field is replaced with the default alpha value. In this manner, frame buffer memory is saved by replacing the destination alpha value with the count value, and yet blending modes involving destination alpha may still be used with the default alpha value. In both of these embodiments, frame buffer memory and read bandwidth are conserved.

Each time a pixel is read from the image buffer by the frame buffer controller, the count value read from the pixel's count bit field is compared with the count value stored in the first clear count register. If the two count values are unequal, the color value read from the pixel's color bit field is replaced with the clear color value stored in the first clear color register. Also, whenever a pixel is read from the image buffer by the video controller, the count value read from the pixel's count bit field is compared with the count value stored in the second clear count register. If the two count values are unequal, the color value read from the pixel's color bit field is replaced with the clear color value stored in the second clear color register.

In a further embodiment, numerous sets of clear count, clear color, and clear enable registers are provided in the video controller. Each set corresponds to one window on the display. For each pixel read from the image buffer by the video controller, attribute bits corresponding to the pixel select one set of clear color, clear count, and clear enable registers to be used in the comparison and conditional color replacement steps. In this manner, the fast clear technique of the invention may be applied in environments in which more than one window is displayed at the same time.

In yet a further embodiment, numerous pairs of clear count and clear color registers are provided in the frame buffer controller to better support double buffering and stereo operations. Each pair of registers corresponds either to a front-left, front-right, back-left or back-right image buffer. A buffer count indicator (or another suitable indicator derived, for example, from a frame buffer address) may be used to select the appropriate pair of clear count and clear color registers for a given operation.

DETAILED DESCRIPTION OF THE PREFERRED EMBODIMENTS

Figure 1:
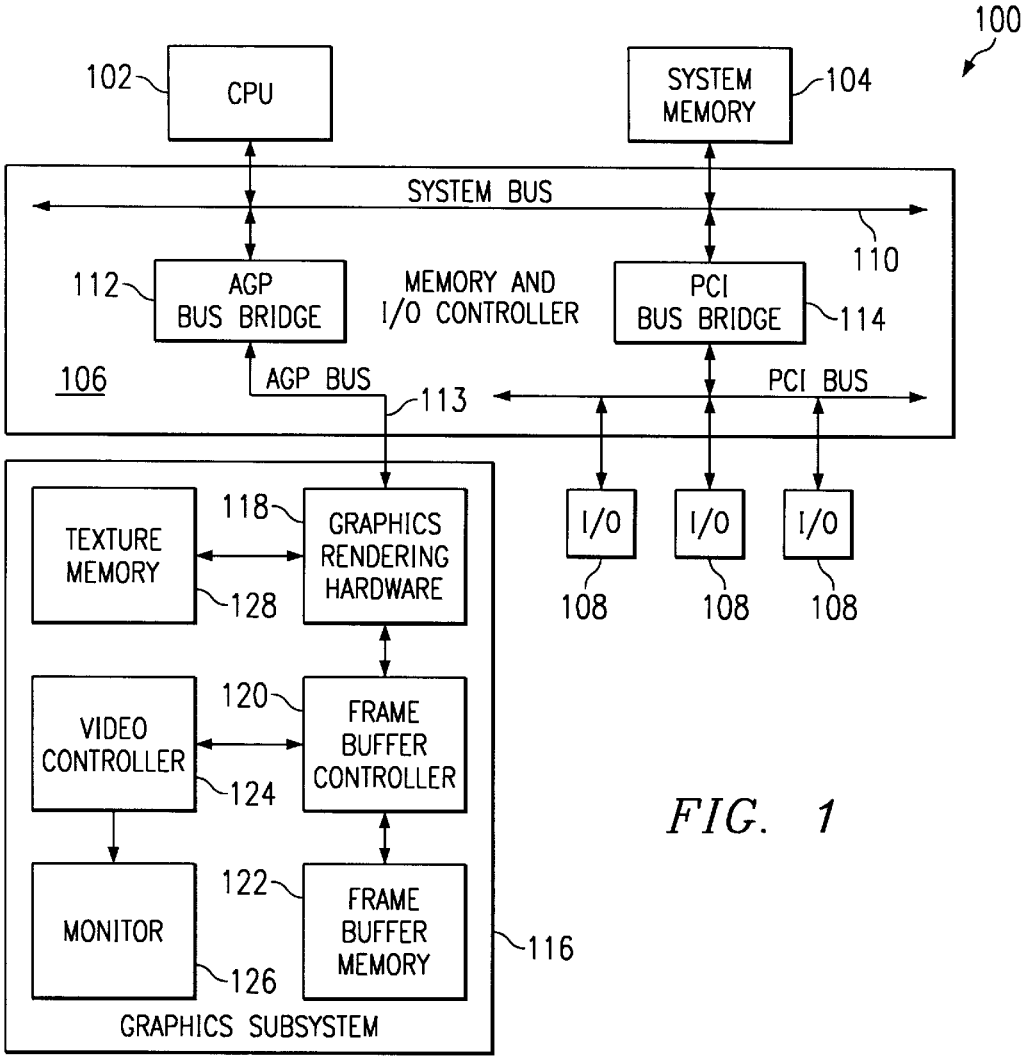
FIG. 1 is a block diagram illustrating a representative computer system suitable for hosting a preferred embodiment of the invention.

FIG. 1 illustrates a typical computer system 100 suitable for hosting a preferred embodiment of the invention. Computer system 100 includes at least one CPU 102, system memory 104, memory and I/O controller 106, and several I/O devices 108 such as a printer, scanner, network interface or the like. (A keyboard and mouse would also usually be present as I/O devices, but may have their own types of interfaces to computer system 100.) Typically, memory and I/O controller 106 will include a system bus 110 and at least one bus interface such as AGP bus bridge 112 and PCI bus bridge 114. PCI bus bridge 114 may be used to interface I/O devices 108 to system bus 110, while AGP bus bridge 112 may be used, for example, to interface graphics subsystem 116 to system bus 110. The specific types of buses shown in the drawing, as well as the architecture of computer system 100, are provided by way of example only. Other bus types and architectures may be used to implement the invention.

Graphics subsystem 116 will typically include graphics rendering hardware 118, frame buffer controller 120 and frame buffer memory 122. Frame buffer controller 120 is interfaced with a video controller 124 (e.g., DACs and sync and blank generation circuitry) for driving display monitor 126. Graphics rendering hardware 118 will typically include 2D (and perhaps 3D) geometry acceleration hardware interfaced with AGP bus 113, and rasterizer/texture mapping hardware interfaced with texture memory 128 and frame buffer controller 120. Of course, not all graphics subsystems 116 will be optimized for texture mapping operations, and texture mapping capability is not required to implement the invention.

By way of further background, it is known to store an alpha transparency value in frame buffer memory 122 in association with R, G and B color component values. In systems that employ such alpha transparency values, new pixel values generated within graphics rendering hardware 118 may not be written directly into frame buffer memory 122. Instead, they may be blended with pixel values already resident in frame buffer memory. Numerous blending modes are possible. For example, see the discussion of image compositing in § 17.6 of James D. Foley et al., *Computer Graphics Principles and Practice*, 2d Ed. (Addison-Wesley 1990); and the discussion of blending in chapter 6 of Mason Woo et al., *OpenGL Programming Guide*, 2d Ed. (Addison-Wesley 1997).

It is also common to organize the width of frame buffer memory 122 physically in 8-bit increments. Thus, it is common to employ a 32-bit word size wherein each word corresponds to one pixel and contains 8 bits each for R, G and B color components plus an 8-bit alpha transparency value. In such systems, one 32-bit read can be performed to retrieve all color and alpha information associated with a single pixel.

By way of still further background, it is known to store per-pixel attribute bits in frame buffer memory 122. These bits may be used, for example, to locate a pointer to the beginning of an image buffer for the window in which a particular pixel resides. In addition, some computer graphics systems do not store R, G and B color components separately in frame buffer memory. Instead, such systems simply store per-pixel color index values in the frame buffer. The color index values are used by video controller 124 as an index into a color look-up table ("color LUT"). The color LUT outputs the R, G and B color components necessary to feed the digital-to-analog converters ("DACs") that drive display monitor 126. In such systems, numerous different color LUTs may be used simultaneously, potentially one for each of the windows that are currently being displayed on monitor 126. As video controller 124 reads frame buffer memory to execute a raster scan display pattern on monitor 126, it reads the attribute bits along with the color index values. For each color index value read, the associated attribute bits determine which color LUT will be used in generating R, G and B values for the pixel.

For purposes of illustrating the invention, a detailed description of an embodiment will now be given wherein the invention is applied to an image buffer (also know as a color buffer) within computer system 100. But the illustrative embodiment described herein is not intended to limit the scope or application of the invention strictly to image buffers. The invention may also be applied beneficially to depth buffers (also known as Z buffers) and other kinds of buffers commonly used in graphics applications.

Figure 2:
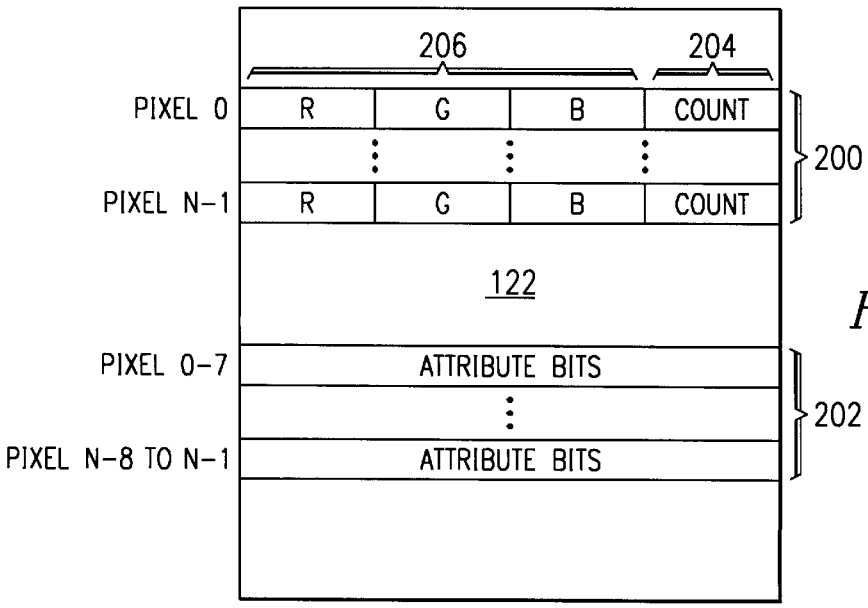
FIG. 2 is a block diagram illustrating data organized within the frame buffer memory of FIG. 1 according to a preferred embodiment of the invention.
Figure 3:
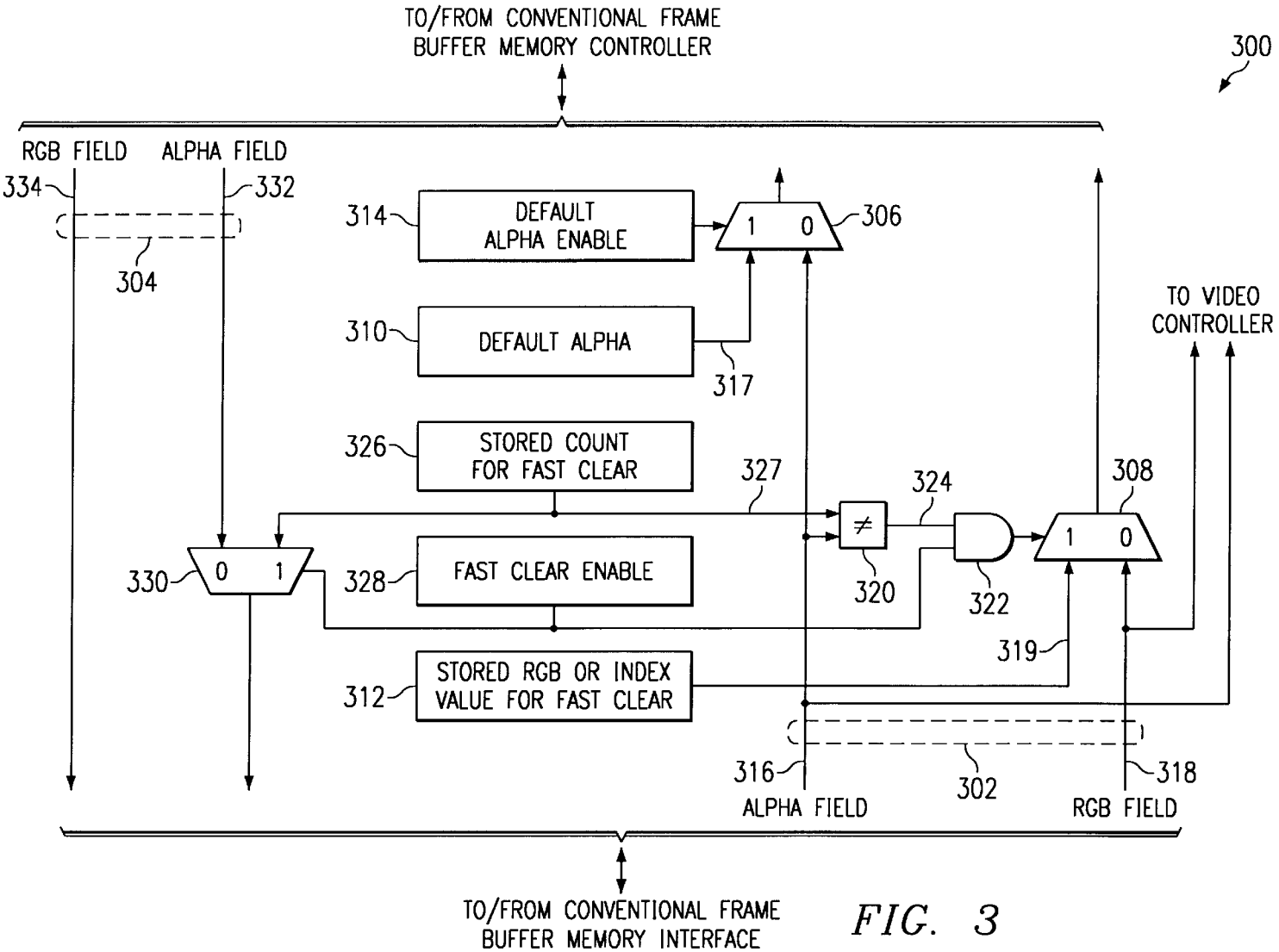
FIG. 3 is a block diagram illustrating novel hardware to be placed within the frame buffer controller of FIG. 1 according to a preferred embodiment of the invention.

Frame Buffer Data Format. FIG. 2 illustrates an image buffer 200 and an attribute buffer 202 within frame buffer memory 122. Attribute buffer 202 is conventional and is shown having four bits per pixel. Image buffer 200, however, is unconventional: The 8-bit field 204 that would normally be used to store alpha information has been used to store a count value. The 24-bit field 206 is used to store 8 bits each of R, G and B information (or, alternatively, 24 bits of color index). FIG. 3 is a block diagram illustrating novel hardware 300 that makes use of and maintains image buffer 200. Preferably, hardware 300 is located within frame buffer controller 120 between the frame buffer memory interface (conventional) and the remainder of frame buffer controller 120 (also conventional).

Read Path. Multiplexer 306 is interposed in the alpha field of read path 302. Multiplexer 308 is interposed in the RGB field of read path 302. Depending on the state of default alpha enable register 314, either the alpha field 316 read from image buffer 200 or the alpha field 317 stored in default alpha register 310 will be supplied to the frame buffer memory controller in response to a read request for a given pixel. Similarly, depending on the state of the select input of multiplexer 308, either the RGB field 318 read from image buffer 200 or the RGB field 319 stored in fast clear value register 312 will be supplied to the frame buffer memory controller in response to a read request for a given pixel.

The state of the select input of multiplexer 308 is controlled by comparator 320 and AND gate 322. For each pixel, comparator 320 will assert output 324 if the value in alpha field 316 is not equal to the count value stored in fast clear count register 326. Assuming a "1" has been stored in fast clear enable register 328, such an assertion on output 324 will cause stored RGB value 319 to replace read RGB field 318. Alternatively, if read alpha field 316 is the same as the stored count in register 326 (or if a "0" has been stored in fast clear enable register 312), then read RGB field 318 is not replaced. The size of clear count register 326 must be less than or equal to the size of count field 204 in image buffer 200. Data sent to the video controller bypasses clear count, clear RGB and default alpha values in the frame buffer controller and uses the second clear count and clear RGB values in the video controller as part of the display path.

Write Path. Multiplexer 330 is interposed in the alpha field of write path 304. Depending on the state of fast clear enable register 328, either the alpha field 332 provided by the frame buffer memory controller or the count value stored in fast clear count register 326 will be supplied to the frame buffer memory interface during a write operation. RGB field 334 is unaltered.

Figures 4, 5:
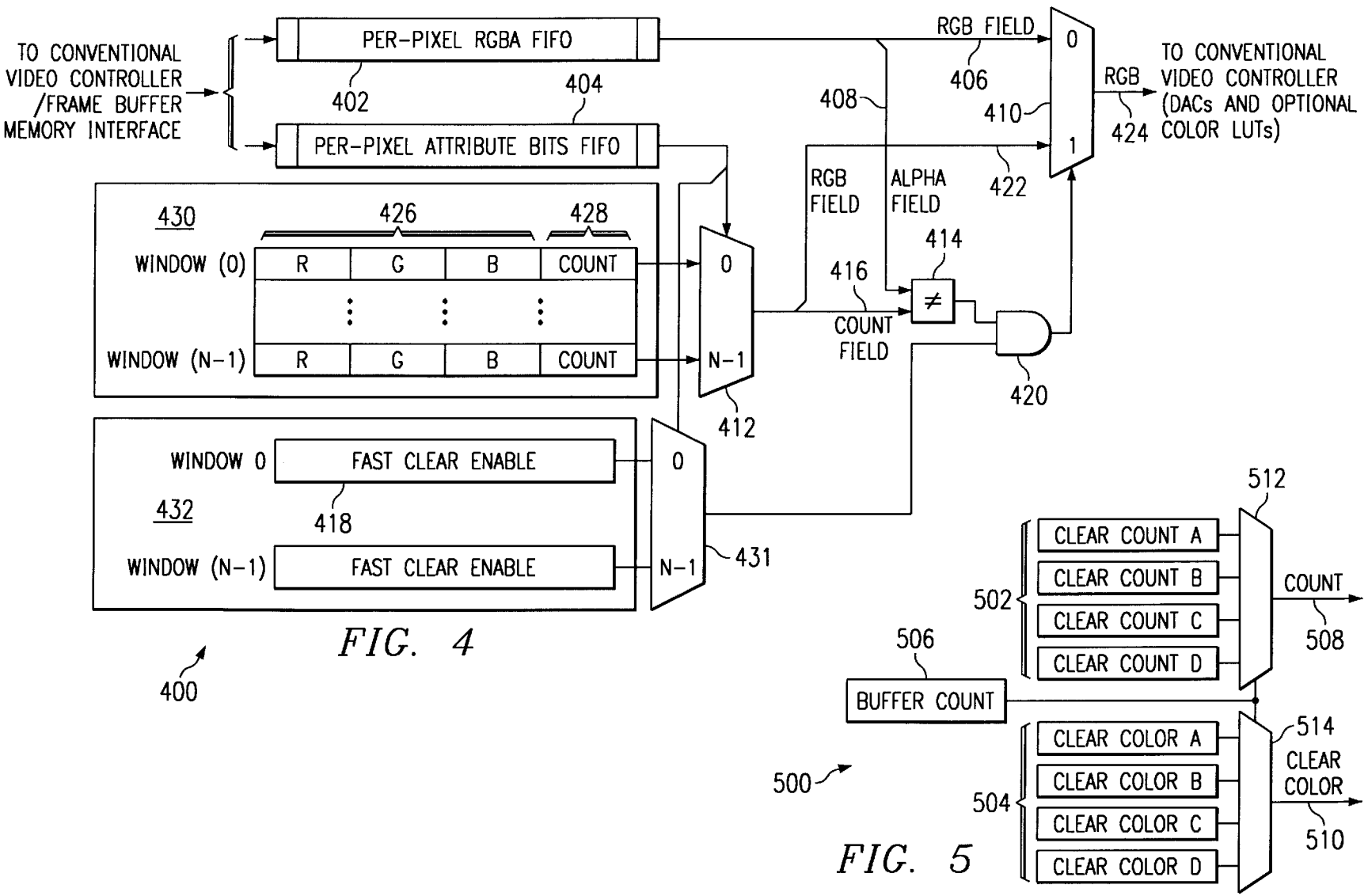
FIG. 4 is a block diagram illustrating novel hardware to be placed within the video controller of FIG. 1 according to a preferred embodiment of the invention.
FIG. 5 is a block diagram illustrating novel hardware that may be placed within the frame buffer controller of FIG. 1 to support operations involving front-left, front-right, back-left and back-right image buffers.

Display Path. FIG. 4 is a block diagram illustrating novel hardware 400 that makes use of image buffer 200 and attribute buffer 202. Preferably, hardware 400 is located within video controller 124 between the video controller/frame buffer memory interface (conventional) and the remainder of video controller 124 (DACs and optional color LUTs, also conventional). In register set 430, n registers are provided, one for each window(0) to window(n−1) that can be displayed simultaneously on monitor 126. In addition, in register set 432, n fast clear enable registers are provided, one for each window(0) to window(n−1) that can be displayed simultaneously on monitor 126.

For each pixel to be displayed, a 32-bit RGBA value read from image buffer 200 is supplied to RGBA FIFO 402, and a 4-bit attribute field from attribute buffer 202 is supplied to attribute bits FIFO 404. The 4-bit attribute field for each pixel is used to select one of the registers within register set 430 via multiplexer 412 and one of the fast clear enable registers within register set 432 via multiplexer 431. Multiplexer 410 is interposed in the RGB path from the video controller/frame buffer memory interface and the remainder of video controller 124. The RGB field 406 from the output of RGBA FIFO 402 is supplied to one input of multiplexer 410, and the RGB field 422 from the output of multiplexer 412 is supplied to the other input of multiplexer 410. The alpha field 408 from the output of RGBA FIFO 402 is supplied to one input of comparator 414. And the count field 416 from the output of multiplexer 412 is supplied to the other input of comparator 414. By virtue of AND gate 420 (and assuming a "1" has been stored in the selected fast clear enable register 418), RGB field 406 will be presented to RGB path 424 when alpha field 408 and count field 416 are equal; but RGB field 422 will be presented to RGB path 424 when alpha field 408 and count field 416 are unequal. If a "0" has been stored in the selected fast clear enable register 418, then RGB field 406 will always be presented to RGB path 424.

Operation. Frame buffer memory and read bandwidth will be preserved whenever color bit fields 206 and count bit fields 204 are part of the same word of frame buffer memory. One way to achieve this is to utilize unused bits in each word as count bits. Another way to accomplish this is to use alpha field bits for count bits, in lieu of an alpha transparency value. As was mentioned above, numerous blending modes are possible in a graphics system. The latter technique takes advantage of blending modes in which the destination alpha value (the alpha value stored in the frame buffer) is not used. In addition, as will be explained below, the latter technique may also be used with blending modes wherein the destination alpha value is used—provided a constant default alpha value can be used in place of the destination alpha value.

In operation, driver software resident in system memory 104 must initially cause a "real" clear of image buffer 200: It does so by loading "0" into clear count register 326, writing a "1" into fast clear enable register 328, and then writing an appropriate clear value into each of RGB fields 206 in image buffer 200. (Because fast clear has been enabled, a "0" will be placed in count field 204 for each pixel written during the "real" clear operation.) The clear value should also be written into fast clear value register 312. Also, to set up operation in video controller 124, driver software should set the appropriate fast clear enable register for the window(418) to a "1" and initialize registers 430 with clear color values and count values corresponding to those that have been written into frame buffer memory 122.

Application software may then draw a frame of an image into image buffer 200. For each succeeding frame of the image, the driver software simply increments the count value stored in register 326 (and the corresponding count values in registers 430) prior to drawing into image buffer 200. No further "real" buffer clears are required until a count value wraps to zero. Thus, for example, if eight bits are provided in count field 204 and clear count register 326, 256 frames may be drawn between real clears—a significant savings.

As an additional feature, a default destination alpha value may be written (by the driver software) into default alpha register 310, and a "1" written into default alpha enable register 314. If this is done, then the value stored in register 310 will be used as the destination alpha value during blending operations—in lieu of the value read from the frame buffer in alpha field 316. The default alpha feature may be used in conjunction with or independently of the fast clear feature.

Another additional feature is illustrated in FIG. 5. For implementations in which front-left, front-right, back-left and back-right image buffers are maintained, multiple clear count registers 502 and multiple clear color registers 504 may be provided in frame buffer controller 120. A buffer count indicator 506 (or an indicator derived from a frame buffer address) may be used as the select input to multiplexers 512 and 514 to select among the multiple clear count and clear color registers to produce an appropriate count value 508 and color value 510 given the operation being performed. In such an embodiment, count value 508 would be used in the same manner as count value 327 shown in FIG. 3. And color value 510 would be used in the same manner as color value 319.

While the invention has been described in detail in relation to a preferred embodiment thereof, it should be understood that the described embodiment has been presented by way of example only and not by way of limitation. It will be understood by those skilled in the art that various changes may be made in the form and details of the described embodiment without departing from the spirit and scope of the invention as defined by the appended claims and their equivalents. For example, although clear count registers, clear color registers and enable registers have been discussed herein as though they were all separate registers, in other embodiments some of these registers may be consolidated so that a single register may contain a clear count value, a clear color value and an enable value in separate bit fields.

What is claimed is:

1. A method of organizing and utilizing an image buffer to reduce the frequency of buffer clear operations, comprising the steps of:

a) storing a clear color value in a first clear color register in a frame buffer controller and in a second clear color register in a video controller;

b) storing a count value in a first clear count register in the frame buffer controller and in a second clear count register in the video controller;

c) for each pixel in the image buffer, writing the clear color value into a color bit field and writing the count value into a count bit field;

d) drawing an image into the image buffer while writing the count value stored in the first clear count register into the count bit field of each pixel modified during the drawing step; and e) incrementing the count value stored in the first and second clear count registers;

f) repeating steps d) and e) until the count value stored in the first and second clear count registers reaches a maximum value; and then g) repeating steps a), b) and c).

2. The method of claim 1, wherein the color bit field and the count bit field are part of the same word of frame buffer memory.

3. The method of claim 2, wherein the count bit field is an alpha bit field and the count value is stored in the count bit field in lieu of an alpha transparency value.

4. The method of claim 3, further comprising the steps of:

storing a default alpha value in a default alpha register in the frame buffer controller; and whenever a pixel is read from the image buffer by the frame buffer controller, replacing the count value read from the pixel's count bit field with the default alpha value stored in the default alpha register.

5. The method of claim 1, further comprising the step of:

whenever a pixel is read from the image buffer by the frame buffer controller, comparing the count value read from the pixel's count bit field with the count value stored in the first clear count register and, if the two count values are unequal, replacing the color value read from the pixel's color bit field with the clear color value stored in the first clear color register.

6. The method of claim 5, further comprising the step of selecting, responsive to a buffer count indicator, the first clear count register and the first clear color register from a plurality of clear count registers and clear color registers located in the frame buffer controller.

7. The method of claim 1, further comprising the step of:

whenever a pixel is read from the image buffer by the video controller, comparing the count value read from the pixel's count bit field with the count value stored in the second clear count register and, if the two count values are unequal, replacing the color value read from the pixel's color bit field with the clear color value stored in the second clear color register.

8. The method of claim 7, wherein:

step a) comprises storing a set of clear color values in a set of clear color registers in the video controller;

step b) comprises storing a set of count values in a set of clear count registers in the video controller;

each clear color register in the set of clear color registers and each clear count register in the set of clear count registers corresponds to a window to be displayed; and the comparing step comprises selecting, responsive to attribute bits corresponding to the pixel, one clear color register from the set of clear color registers and one clear count register from the set of clear count registers.

9. Apparatus for utilizing an image buffer to reduce the frequency of buffer clear operations, comprising:

a first clear color register in a frame buffer controller;

a second clear color register in a video controller;

a first clear count register in the frame buffer controller;

a second clear count register in the video controller;

circuitry in the frame buffer controller for writing the contents of the first clear color register and the first clear count register into a color bit field and a count bit field, respectively, of every pixel in an image buffer during buffer clear operations;

circuitry in the frame buffer controller for writing the contents of the first clear count register into the count bit field of every pixel in the image buffer that is modified during rendering operations; and circuitry in the video controller for comparing the count value read from each pixel's count bit field with the count value stored in the second clear count register and, if the two count values are unequal, replacing the color value read from the pixel's color bit field with the clear color value stored in the second clear color register.

10. The apparatus of claim 9, wherein the color bit field and the count bit field are part of the same word of frame buffer memory.

11. The apparatus of claim 10, wherein the count bit field is an alpha bit field and the count value stored in the count bit field is in lieu of an alpha transparency value.

12. The apparatus of claim 10, further comprising:

a default alpha register in the frame buffer controller; and circuitry for replacing the count value read from each pixel's count bit field with the contents of the default alpha register.

13. The apparatus of claim 9, further comprising:

circuitry in the frame buffer controller for comparing the count value read from each pixel's count bit field with the count value stored in the first clear count register and, if the two count values are unequal, replacing the color value read from the pixel's color bit field with the clear color value stored in the first clear color register.

14. The apparatus of claim 13, further comprising circuitry for selecting, responsive to a buffer count indicator, the first clear count register and the first clear color register from a plurality of clear count registers and clear color registers located in the frame buffer controller.

15. The apparatus of claim 9, wherein the second clear count register is one of a set of clear count registers in the video controller and the second clear color register is one of a set of clear color registers in the video controller, and the second clear enable register is one of a set of clear enable registers in the video controller, each clear count register in the set of clear count registers and each clear color register in the set of clear color registers and each clear enable register in the set of clear enable registers corresponding to a window to be displayed; and further comprising circuitry in the video controller for selecting, responsive to attribute bits corresponding to a pixel, one clear color register from the set of clear color registers and one clear count register from the set of clear count registers and one clear enable register from the set of clear enable registers.

* * * * *